US005450634A

United States Patent [19]

Mohrman

[11] Patent Number: 5,450,634

[45] Date of Patent: Sep. 19, 1995

[54] INCREMENTAL DUAL STORAGE WATER FLUSH TOILET

[76] Inventor: John H. Mohrman, 301 Village Road, Orwigsburg, Pa. 17961

[21] Appl. No.: 281,514

[22] Filed: Jul. 28, 1994

Related U.S. Application Data

[63] Continuation-in-part of Ser. No. 948,120, Sep. 20, 1992, abandoned.

[51] Int. Cl.[6] ..... E03D 1/14

[52] U.S. Cl. ..... 4/326; 4/346; 4/405

[58] Field of Search ..... 4/324, 325, 346, 405, 4/415, 326, 327, 413, 414

[56] References Cited

U.S. PATENT DOCUMENTS 5,003,644 4/1991 Huang ..... 4/326 X 5,042,096 8/1991 Bolli ..... 4/326

*Primary Examiner*—Charles E. Phillips

*Attorney, Agent, or Firm*—Arthur R. Eglington

[57] ABSTRACT

An incremental dual stage water-flush toilet has been developed to serve as a means of reducing to an absolute minimum the amount of water used in a water-flush type toilet. The toilet is comprised of a trapless toilet bowl with spring-loaded air valves over a pipe trap below floor level, and a water storage tank divided into a small and large compartments. An incremental flushing mechanism allows conventional type manual flushing of the toilet but will allow enough water to run into the bowl to cleanse the bowl and wash waste into the pipe trap below for interim retention. After multiple incremental flushings of that limited type, a major bowl flush containing enough water to clear the toilet bowl and also to wash all retained waste in the pipe trap into the available sewer line occurs. The sequence of smaller flushings with a larger flushing is again repeatable.

8 Claims, 3 Drawing Sheets

INCREMENTAL DUAL STORAGE WATER FLUSH TOILET

CROSS REFERENCE TO OTHER APPLICATIONS

This is a continuation-in-part of my pending application U.S. Ser. No. 07/948,120, filed Sep. 20, 1992.

FIELD OF THE INVENTION

The invention relates to the use of the water-flush toilet that causes human waste to flow into sewers, septic tanks or other treatment systems.

BRIEF DESCRIPTION OF THE PRIOR ART

Heretofore, water flush-type toilets were provided with a trap in the base of the toilet specifically to prevent sewer odor from emanating into the facility or building. The tank storing the water to flush the toilet was made smaller and smaller with minimum water storage capacity in an effort to save water. In order to cause waste and paper to flow without blocking sewer lines, current amounts of water being used have been reduced to an absolute minimum. However, even with those limitations excess water is still used in each flush. Since water flush-type toilets are usually flushed after each use, much water is wasted, considering the volume of water used to flush the small amount of liquid, or of liquid, solid and toilet tissue involved. This factor alone, results in the highest volume of water use in most habitable facilities, and continues to be a prime contributing factor in the water shortages experienced in many geographical locations. So, the water flush-type standard toilet has remained relatively unchanged in the general state-of-the-art over the years. Present designs of "water-saver" flush toilets have reduced the amount of water used to flush the toilet down to a minimum, such that they realistically can cause some sewer line blockage.

Toilet manufacturers have categorized their equipment as using a certain amount of water stored in the tank per flush. Such claims tend to imply that only the stored water is used in a single flush. However, additional water is always used during a flushing, since the water level control valve opens temporarily allowing water from the reservoir feed line to supplement the stored water, until such time as the flow of water out of the tank is stopped by the outlet stopper.

Many non-water, flush-type toilets have been invented and patented however, the water flush-type toilet is still the most widely used. This present invention was disclosed in Disclosure Document No. 315089, Aug. 11, 1992.

SUMMARY OF THE INVENTION

The purpose of the invention is to reduce to an absolute minimum the amount of water used to flush a tank-type toilet. The toilet is similar to the water flush-type toilets currently in use, except the toilet bowl and holding tank configurations have been changed to allow for incremental dual flushing. Specifically, as the toilet is flushed by manually depressing a handle, as is the current practice, now only a very small amount of water flows into the bowl to clean the bowl, and enough to flush the waste into a trap which is located below the toilet rather than within the toilet. Successive flushings, using a limited amounts of water occur as the toilet, continues to be used. The waste flows into the trap below the toilet. Incrementally, a final flushing then occurs washing the previous trapped waste and trap clear, and then carrying the collected waste from multiple uses of the toilet into the existing sewer collection system.

By locating the trap below the toilet, rather than forming it inside the toilet, two purposes are served. First, it prevents sewer gases from emanating upward into the facility in which the toilet is located; and second, the added trap, now constructed of selected size pipe fittings, acts as a temporary waste container. The longer the solid waste remains in the present trap, the more it becomes like liquified sludge, thereby flowing more readily through sewage piping without causing any blockage.

The present incremental dual stage water-flush toilet functions to use an absolute minimum of water. A flushing mechanism is provided with a trapless toilet bowl, which has all the features of a conventional toilet, and to provide sufficient water to flush multiple deposits of waste without causing any sewer line blockage. The present trapless toilet is equipped with several spring-loaded air lock valves positioned between the toilet bowl and a trap made of pipe fittings, installed below the toilet. Those valves are caused to open when weighted liquid/solid waste comes in contact with them, and to close when said waste has passed on, thereby preventing odorous fumes from rising upward from the piping below. The toilet tank used to provide the volume of water to flush the waste is divided into a smaller compartment and a larger compartment. The ratio of their storage volumes is about five-to-one. Each compartment is equipped with conventional compact refill valves with a self-contained water level control and each has a water supply line provided.

In a first embodiment of the invention, there is provided, a water-flush toilet system including a refillable, water holding tank, a water collection bowl, a first conduit means for passing a controlled volume of water from the tank to the bowl, a second conduit means for passing water-diluted waste from the bowl to the sewage system, and a first valving means for passing diluted waste from said bowl to interim storage below the bowl, the system further is adapted for incremental water dispensation from the holding tank, with the improvement comprising: a water holding tank divided by an internal partition wall into a first smaller water storage compartment and a second substantially larger water storage compartment; a waste trap zone disposed below the bowl in said second conduit and in communication with said bowl adapted for retaining diluted waste materials passing to it from each incremental water flow from the said smaller compartment; an external knob means on the tank surface adapted to operatively interact with a said traversing means and to shift same horizontally, upon each depression of the knob means; a horizontally-aligned, traversing plate mounted within the top segment of said holding tank and adapted to shift laterally in incremental steps and then retrogressively, with each incremental step being associated with the release of water held in said smaller tank; a first mechanical actuation means operatively interconnected between an intermediate anchor point on the plate and a first valve means cover provided proximal to the bottom of the second compartment, whereby each lateral shift of the plate opens the first valve means, permitting water flow from the second smaller compartment to the toilet bowl; a second mechanical actuation means operatively interconnected between a movable first support pin associated operatively with the plate and a second valve cover means is provided proximal to the bottom of said first compartment, whereby a lateral and upward shift of said plate opens the second valve means, permitting water flow from said first larger compartment to said toilet bowl; a pair of spaced-apart, axially-aligned linear slots provided in the planar surface of said plate and adapted to operatively receive a pair of horizontally disposed, plate support rigid pins; a plurality of regularly configured, corrugation-like, recesses are disposed along the lower edge of said plate and adapted to make sliding and undulating contact with any elongate lever means nesting in said recesses; a pair of elongate cantilever means affixed at their rotational axis to a support wall and adapted to track the undulating lower edge of said control plate as it shifts; a pair of pivotable elongate lever means, with each of such means affixed at its pivotable longitudinal end to a support wall of the holding tank and hingedly anchored at its other longitudinal end to the external end of one of the horizontally-disposed plate support pins; a third mechanical means operatively attached to the other longitudinal end of said plate and adapted to provide a constant retrogressive lateral force that will shift said plate rightwardly only while the leftward biasing-cantilever means are disconnected from contact with the plate underside recesses; and, a pair of normally vertically aligned, keeper levers riding along the upper edge of said transversing plate and serving to maintain said plate in the lower of its two horizontal levels until the plate shifts laterally to the leftward limit of its traverse, and then said pair adapted to releasing of said plate to move to its upper horizontal level of traverse for return to its initial rightward position by the force now being exerted by said third mechancial means.

DETAILED DESCRIPTION OF THE INVENTION

Figure 2:
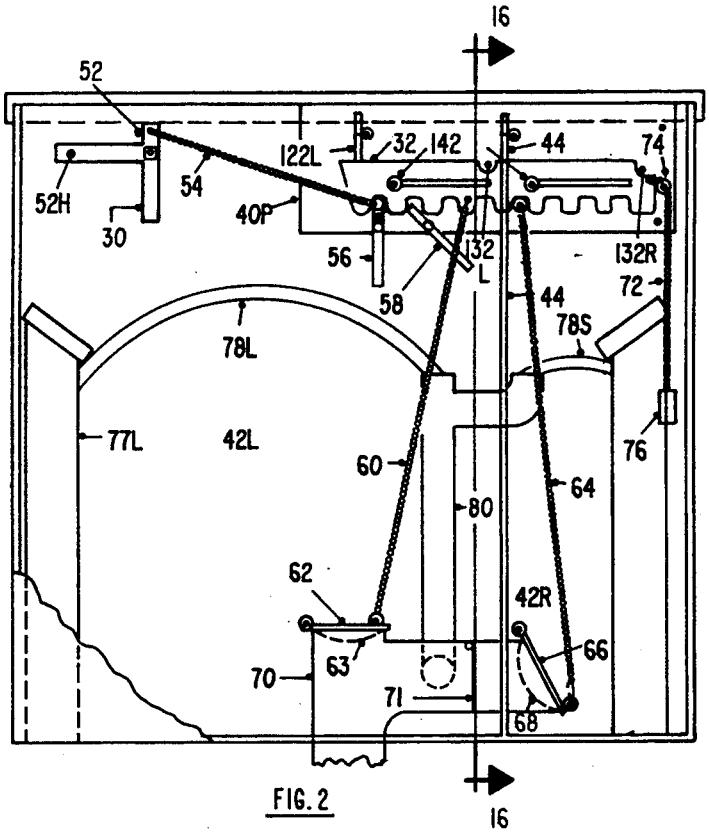
FIG. 2 is a schematic front sectional view of the toilet tank component, showing all of the dual chamber, flushing mechanism linkages.
Figure 16:
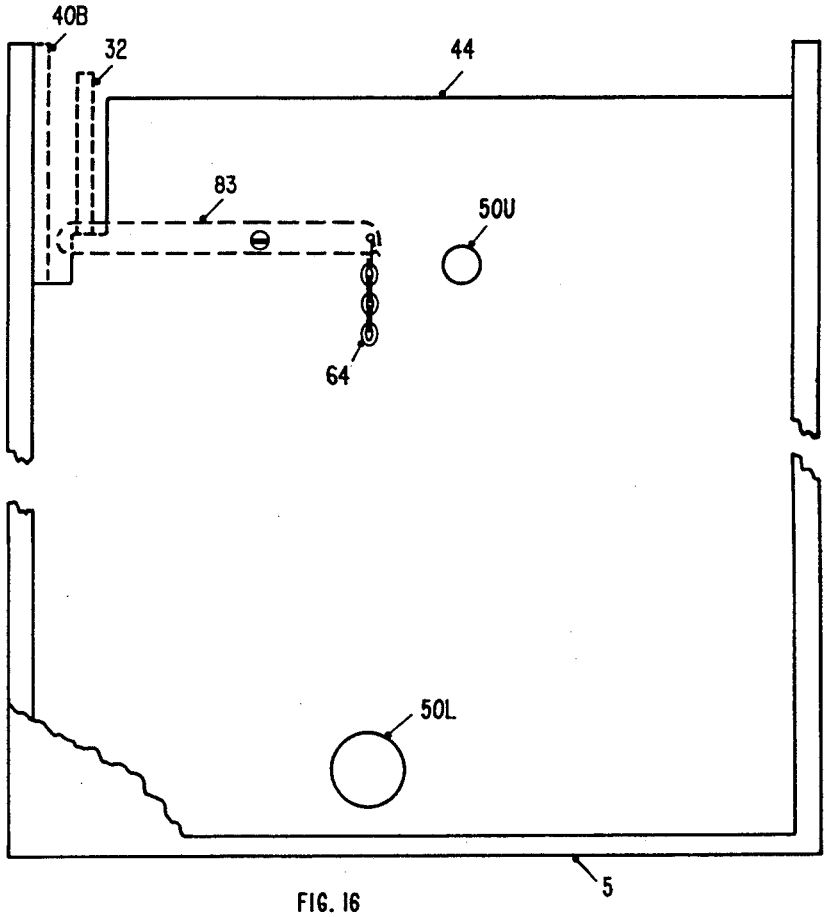
FIG. 16 is an enlarged schematic, left sidewall end view (facing tank) of the vertical planar partition defining the smaller and larger compartments of the water storage tank of FIG. 2, taken along line 16—16 of FIG. 2.
Figure 17:
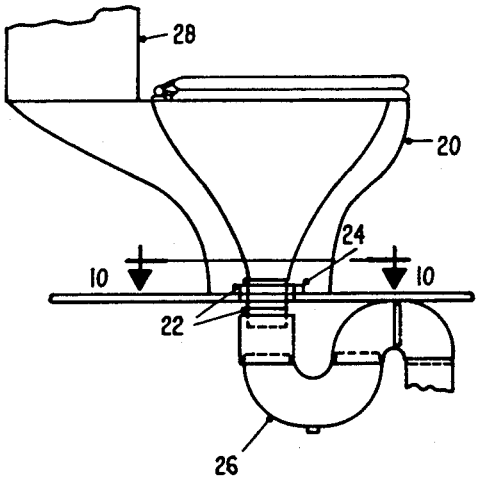
FIG. 17 is a larger size schematic view of the trapless toilet bowl, the holding tank and the spring-loaded air lock valves of FIG. 1, depicting the closet flange and the pipe elements, forming the modified trap for interim waste storage.

The principal functional components comprising the incremental discharge, dual phase flushing toilet are depicted in FIGS. 2–9 and 12–15. In the side schematic of FIG. 17, the toilet bowl 20 is provided at its base outlet with spring-loaded, air lock valves 22, serving to permit water waste to gravitate below from bowel 20 and also to arrest sewer odors arising from below into the bowel. It comprises closet flange 24 and conduit trap 26, both located below valve 22. This conduit with an enlarged waste storage volume serves as an interim liquefied waste container. In the schematic of FIG. 2, there is seen an internally compartmented water holding tank 28, including the manual flushing mechanism, generically 30, with the major elements being a horizontally-aligned, planar and generally rectangular traversing, flush control plate 32, which plate is provided on its lower linear surface with a regular series of smooth arc-like indentations 34 (regularly configured corrugations) later to be detailed. Such indentations are preferably over its entire length. This plate has its longer linear dimension positioned longitudinal of the tank configuration, which dimension ranges from six-to-ten times its planar traverse dimension. Plate 32 is also provided with two spaced-apart, axially-aligned, linear slots 36L, 36R, which slots permit a limited range of lateral and reciprocal travel for the plate itself. Plate 32 is partially supported upon the headed mounting pins, 38L, 38R, which project fixedly from holding tank rear wall (seen in FIG. 4/5). Holding tank 28 is itself vertically separated into two compartments, 42L and 42R, via partition wall 44, which extends from the bottom wall 46 of the holding tank almost to the top edge thereof, i.e., to a point just below removable downward flanged edge tank cover 48. (An end view of partition wall 40 is presented in FIG. 16, depicting rounded spaced-apart, conduit apertures 50U and 50L.) External action arm 52 is pinned internally of tank 28 to one end of a flexible chain 54, the other longitudinal end of which chain is pinned to the upper segment of pivotable, linear pin 56, which segment initially rests in the left hand most underrecess 34L of the indentations 34 on traversing plate 32. Spaced apart from linear, spring-loaded pivotable pin 56 is a second similar spring-loaded pin 58, the upper segment of which rests in the adjacent recess 34R of the indentation series 34.

Figure 1:
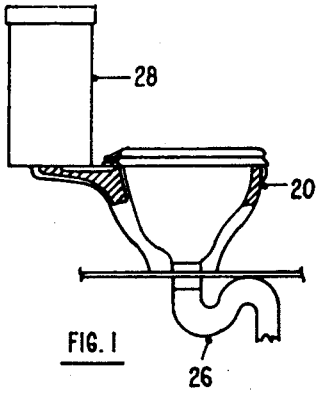
FIG. 1 is a side schematic view of the trapless toilet-bowl, the holding tank and of the spring-loaded air lock valves, disposed between the toilet and a piped trap below (of the present invention)

A second flexible chain 60 depends from midway of plate 32 (being anchored thereto) running through larger water compartment 42L, to be pinned at its lower longitudinal end to the free edge of first float valve cover 62 hingedly secured (and sealing) over the first outlet orifice 63. A third flexible chain 64 depends from a horizontal pin 65 nested in lower edge of plate 32 (slot 34), and is pinned at its lower longitudinal end to the free edge of second float valve cover 66, which is hingedly secured (and sealing) over the second inclined orifice outlet 68. Both orifices 63 and 68 conjoin to provide common conduit 70, which as needed, carries flushing water from the holding tank compartments to toilet bowl 20 (FIG. 1). Looking to FIG. 2, in common conduit 70 there also is positioned an upward edge, flapper valve 71 serving to preclude water backflow from larger compartment 42L into the smaller compartment 42R when the latter is sporadically emptied.

Finally, a fourth flexible chain 72 extends from being anchored to the right hand vertical edge of plate 32, over rotor 74, terminating at its lower end in depending weight 76, which biases the traversing plate to move rightwardly when other lever leftward forces are not dominant, to be described. Normally, the spring-loaded pressure of lever 58 upon underedge indentations lock each incremental movement in place by exceeding the bias of weighted chain 72 tending to draw plate 32 in a retrogressive lateral direction.

Vertical column 77L serves as the water level control means for compartment 42R, directing any overflow via arcuate conduit 78L to vertical stand pipe 80, which itself connects to its lower end with flushing common conduit 70. Similarly, any overflow from small compartment 42R flows via conduit 78S also to stand pipe extension 80S. Thus, any inner holding tank overflow is directed to the main tank outlet conduit flowing to the toilet bowl.

Averting briefly again to FIG. 16, partition wall 44 presents an upper port 50U which admits of the diameter of side stand pipe 80S (FIG. 2), and the wall below also presents port 50L, which admits of the diameter of common conduit 70S (FIG. 2).

Also in the upper segment of FIG. 16, there is presented a horizontal linear solid bar 83 which serves as the cantilevered means for flushing water from small compartment 42S via chain 64 operatively connected to float valve 66 (not seen).

Figure 3:
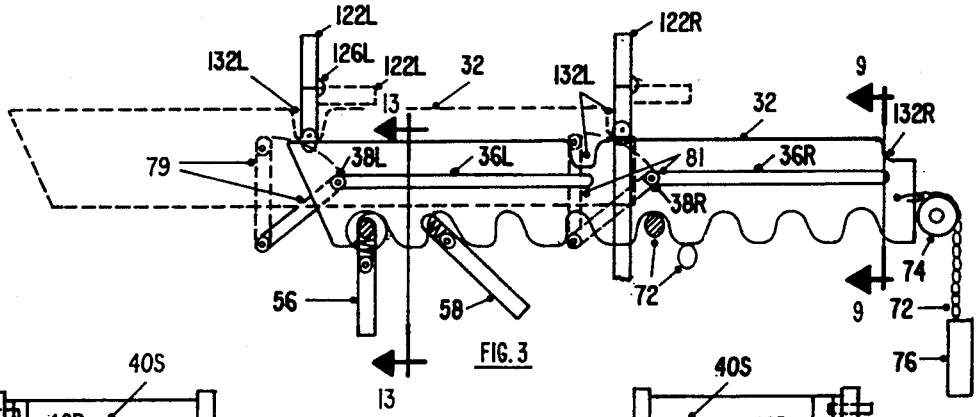
FIG. 3 is a broken out, detailed, enlarged front view of the traversing control plate and associated mechanism linkages partly seen in the upper segment of FIG. 2.

Looking to the broken out, enlarged schematic view of FIG. 3, greater detail on the function of the traversing plate and associated actuation means is provided. The rightmost end position (lower) of the plate and its associated parts is depicted in solid lines, while the leftmost end position (upper) of the plate is seen in phantom lines. At the start of the incremental flushing cycle, the plate position is that depicted in solid lines. Each push on external lever 30 (FIG. 2), shifts plate 32 one indentation 34 leftward, overcoming the rightward counterforce provided by weight 76. Adjacent pivoting pin 58 follows along. Hinged swing pin 79 is functionally linked at its upper movable end to slot support pin 38L, initially located at the leftward end of left-side slot 36L. Similarly, second hinged swing pin 81 is functionally linked at its movable end to the other slot support pin 38R, which is located at the leftward end of the right side slot 36R. Note the projecting end of bar 83 in FIG. 3, having alternate spots, dependent upon the lateral position of plate 32. The full-view, horizontally-projecting cantilevered bar 83 (of FIG. 16) travels along an underside indentation ridge (as shown) when plate 32 is moving laterally, swinging bar 83 to uplift chain 64, and release water from compartment 42R.

The alternate other end position of plate 32 as it is shifted leftwardly, and somewhat upwardly is seen in FIG. 3, with the latter upward shift being induced by the upward arcing of anchored levers 79 and 81. The uplift of the bottom edge of plate 32 permits same to clear levers 56/58, and retrogress to the starting position.

Figure 4:
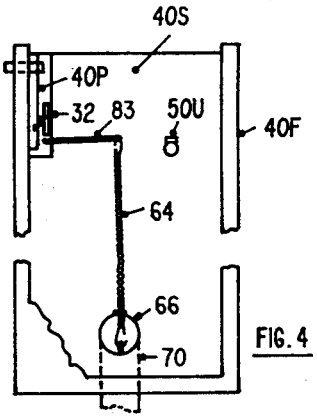
FIG. 4 is a broken out, schematic vertical sectional view inside the right-hand (facing) sidewall of the holding tank of FIG. 2.
Figure 5:
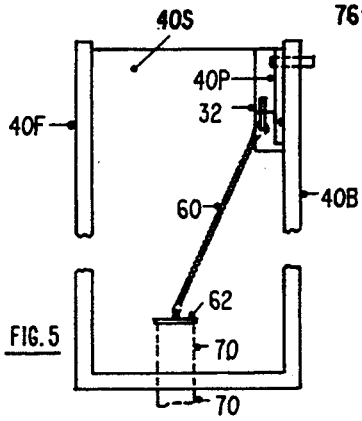
FIG. 5 is a broken out, schematic vertical sectional view of inside the left-hand (facing) sidewall of the same holding tank.

The elevational, sectional side view of FIG. 4 (looking leftward from partition wall 44) is similar to that of FIG. 16, but denotes the flexible chain 64 which extends between cantilever 83 and smaller compartment float valve lid 66. The vertical sectional side view of FIG. 5 (looking rightward from wall 44) shows that chain 60 extends between its intermediate fixed anchor point on plate 32 down to the horizontal float valve 62 of larger compartment 42L.

Figure 12:
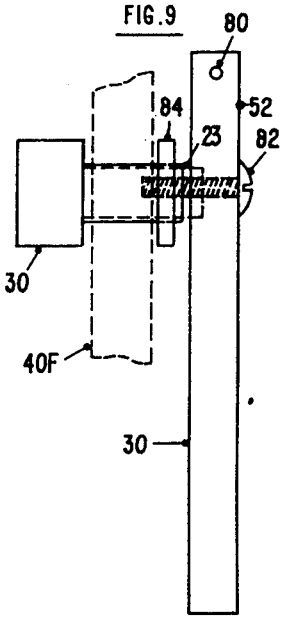
FIG. 12 is a broken-away, enlarged, side view of the detail of the manual lever of FIG. 2.

In FIG. 12 is a broken away, enlarged view of the manual flushing lever 30 of FIG. 2. The depending segment 30W is the weighted portion, that returns the manual lever to its original position after manual release. Port 80 in the upper edge of lever segment 52 secures one free end of the flexible chain 54 (FIG. 2). Threaded bolt 82 pins segment lever 30 to the holding tank front wall 40F, while its threaded nut 84 retains the bolt in place. Main lever 30 is an integral to horizontal lever arm 52H (FIG. 2) that projects outside the tank for manual activation.

Figure 13:
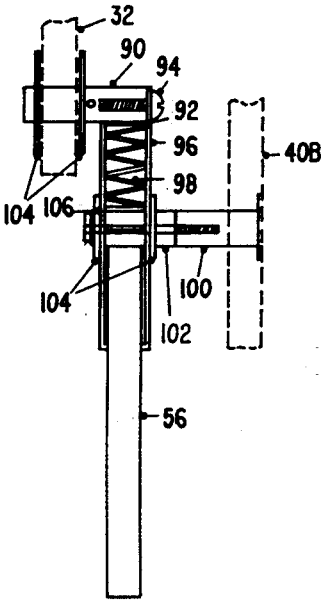
FIG. 13 is a broken-away, enlarged, right side, end view of one of the spring-loaded, bottom weighted levers of FIG. 3, that moves along the traversing control plate, taken along line 13—13 thereof.
Figure 14:
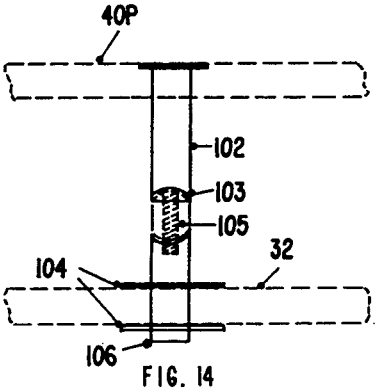
FIG. 14 is a schematic top plan view of one of the two spring-loaded, weighted support pin lever of FIG. 3 that moves along the linear slots provided in the traversing control plate of FIG. 3.

In the broken-out, enlarged, detail vertical sectional view of FIG. 13 is depicted an upper-end, spring-loaded, bottom weighted, first cantilever 56 of FIG. 3, which is operatively tied via chain 54 to manual activation arm 52. Cantilever 56 (front side seen in FIGS. 2 and 3), serves to bias traversing plate 32 in a leftward direction. Note the functional elements of lever assembly 56 are disposed, generally vertically, are located between the tank back wall 40B and the planar vertical surface of plate 32. Upper rigid pin 90 is the horizontal element that rides along the lower edge, even indentations 34 of plate 32, being secured at its inner end to the partly truncated upper lip, 92 of lever 56 by threaded bolt 94. The upper segment of lever 56 is a cylindrical shell 96, adapted to receive a toroidal spring 98, the upper end of which spring is retained by pin 90, and the lower end of which spring 90 is retained by horizontal pivot pin 100. This spring-induced bias permits upper horizontal pin 90 to move vertically and reciprocally along the plate indentations 34 while axially pinned on lip 92 within the lever hollow shell 96. Disposed about lower support pin 100 is detachable collar 102, which carries external washer-type guides 104, located external of the middle segment; collar 102 is axially pinned with retaining bolt 106 to pin 100. The resulting assembly facilitates reciprocal movement of toroidal spring 90 and lever 56 responsive to the motion of plate 32.

Figure 6:
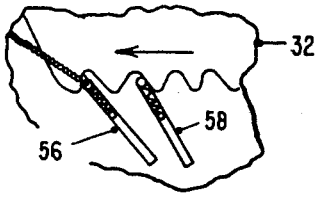
FIG. 6, 7 and 8 are schematic, cut away views portraying the incremental positions, sequentially in numbered order, of the pair of wall-offset, spring-loaded, weighted, trip-lock levers that moves laterally across a portion of the underside of the traversing plate of FIG. 3.
Figure 7:
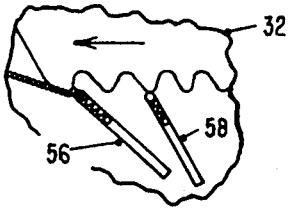
Figure 8:
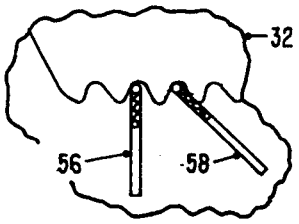

The adjacent spring-loaded, weighted lever 58 serves to lock each incremental leftward movement of the plate 32 in place (by virtue of its inclined angle leftward and the resistance of the adjacent indentation ridge), as depicted in the sequential series of FIGS. 6 to 8 for adjacent swinging lever travel. Then spring bias of levers 56/58 normally precludes the plate 32 from moving rightwardly (laterally) despite the bias imposed by the suspended weight 76 tied to plate 32 via chain 72, until an event, to be described.

Figure 15:
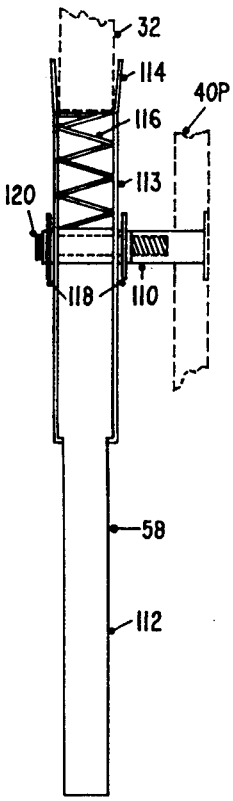
FIG. 15 is another broken-away, enlarged, schematic side view of another horizontal spring-loaded, bottom weighted lever that moves along the bottom corrugated edge of traversing plate of FIG. 3.

Second lever 58 is better seen in the vertical sectional view of FIG. 15. It is also offset from the tank back wall 40B, and being pivotally mounted on tapped horizontal pin 110. Lever 58 has a depending, weighted segment 112, and an upper hollow cylindrical segment (or shell) 113. The upper edge 114 of shell 113 is channeled and flared outwardly to facilitate sliding contact with the undulating (corrugated) lower edge of traveling plate 32. A toroidal spring 116 is loaded into shell channel 114, and this facilitates the reciprocal vertical movement of shell 114 on the indentations 34 of plate 32. Pin 110 retains lever 58 in vertical alignment via external retaining washers 118 and threaded end bolt 120 positioned for securing cantilever 58 to support pin 110.

In FIGS. 2 and 3, there are also depicted top-side, two normally vertically-aligned, keeper levers 122L and 122R, that serve to maintain the traversing plate 32 in its lower level position during most of its lateral traverse (FIG. 3—solid lines). When plate 32 reaches the end position of its leftward travel, it rises to its upper position, as directed by the slot-tracking, pivotable levers 79 and 81. Alternately, when plate 32 rises to its upper position (FIG. 3—phantom lines), then the keeper levers 122L/122R are swung to an angular or horizontal position by the rightward shift of the plate.

Figure 9:
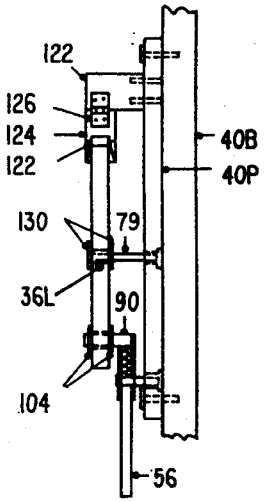
FIG. 9 is a broken out, elevation, right side, end view of upper flushing mechanism action levers of FIG. 3, taken along line 9—9 thereof.
Figure 10:
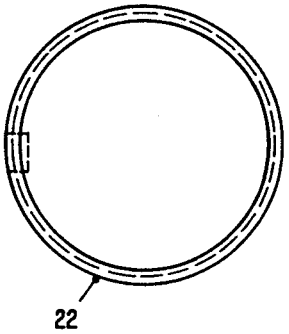
FIG. 10 is an enlarged top plan view of the spring-loaded, air lock tank bottom valve of FIG. 17, taken along line 10—10 thereof.
Figure 11:
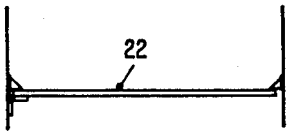
FIG. 11 is a side elevation view of the spring-loaded, air-lock, bowl bottom valve of FIG. 17.

The detailed linkage for movement of the described keeper levers and pivotable levers is better seen in FIG. 9. Hinged lever segment 124 is in a vertically position secured via hinge 126 to detent 128. Keepr levers 122L/R are mounted laterally and offset on the face of tank back wall 40B. A cylindrical roller 130 is positioned to ride on an inward recess 132L located in the top edge of plate 32 (FIG. 3); the roller being contained by the flared outward walls of segment 124. When roller 130 is located in this top recess 132L, then the lower section 124 of keeper lever 122L swings on its hinge to an angular position, whereby the plate 32 rises to its upper position moving leftward, to repeat the incremental flushing sequence. A second recess 132R is provided at the upper edge of the right side longitudinal end of plate 32.

As noted, slot-tracking, pivotable levers 79/81 (45–50) permit the plate 32 to reciprocate between its lower (solid lines) and its upper (dotted lines) positions, as selectively permitted by the keeper lever action (FIG. 9), just described.

Figure 18:
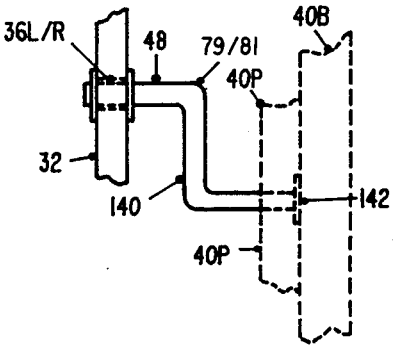
FIG. 18 is a broken-away, elevational side view of a supporting pivotable lever as disposed while the laterally traversing control plate of FIG. 3 is in its alternate upper position.

Averting to FIG. 18, there is seen the broken-out, side view of rear-side (back of plate 32) pivotable levers 79/81. The linear slot 36L of plate 32 rides on a crank-shaped support arm 140. The outward end 140E of support arm 140 has capped retaining washers 142, and the other (inward) longitudinal end of arm 140 is mounted on the holding tank back wall 40B.

IN OPERATION

When the flush lever 30 is manually depressed, the laterally traversing flush plate 32, which is the primary component of the present incremental flushings mechanism is (26)shifted, displacing chain 64, causing the water volume in the smaller compartment 42R to be flushed; this occurs for successive multiple uses of the toilet. Each such limited volume flushing contains sufficient water to cleanse the toilet bowl, and to wash the waste down into the trap zone (26 of FIG. 17). As the traversing control plate is moved laterally and incrementally leftward, stepwise, the standard inflow valve mechanism (not seen) causes the smaller compartment to refill with water to a preset level. The traversing control plate 32, as it continues to move incrementally, travels to an extended final position, whereupon its final levered action causes the larger tank compartment 42L to flush all waste from the toilet and from the trap below into the sewer line. The traversing flushing plate travels on levers 79/81 (FIG. 18) installed on the base plate tank wall. Plate 32 is normally held in a lower horizontal position by vertical hinged keepers (122L/122R), equipped with rollers (130) disposed in the ends of mounted on the base plate (see FIG. 9). The traversing plate is first moved by a spring-loaded, weighted lever 56 being pulled by connecting chain 54, which is activated when the weighted flush lever 30 is manually depressed. The vertical weighted lower end 30W of the flush lever causes it to return to a vertical position. As that movement takes place, a spring-loaded, weighted trip-lock lever 58 retains the traversing plate in place. The spring-loaded, weighted lever retracts around the adjacent protrusion of the corrugated grooves of the plate to become positioned in the next groove to allow flushing action to be repeated.

When the traversing plate 32 travels to the final position (phantom view—FIG. 3) it causes the larger compartment 42L to flush, then hinged keepers 122L/R pivot in the recesses (132L/R) in the top of that plate, so that the lower part of those keepers are forced into a horizontal position, allowing that plate to be raised by the pivotable levers (79/81), which causes the plate to return to its original starting position by the bias of chain-attached weight 76.

Upon reaching its original position, plate 32 is lowered by gravity and by the swivel levers, returning to its starting position, to again begin the series of multiple flushing of the smaller compartment. As the traversing plate reaches that lower position, the top-side hinged keeper levers return to a vertical position, again holding that plate in the lower position for the next traversing cycle. The incremental, reduced volume flushing process is then repeated as the toilet is used, until the final flush phase is achieved.

I claim:

1. In a water-flush toilet system including a refillable, water holding tank, a water/waste collection bowl, and being a first conduit means for passing a controlled volume of water from the tank to the bowl, a second conduit means for passing water-diluted waste from the bowl to the sewage system, and a first valving means for passing diluted waste from said bowl, to interim storage below the bowl the system further being adapted for incremental water dispensation from the holding tank, the improvement comprising:

(a) a water holding tank divided by an internal partition wall into a first larger water storage compartment and a second substantially smaller water storage compartment;

(b) a waste trap zone disposed below the bowl in said second conduit and in communication with said bowl adapted for retaining diluted waste materials passing to it from each incremental water flow from the said smaller compartment;

(c) a horizontally-aligned, traversing plate mounted within a top segment of said holding tank and adapted to shift laterally in incremental steps, with each step being associated with the release of water held in said smaller tank and then to shift retrogressively back to its initial position;

(d) an external knob mounted on a tank surface of the tank and being adapted to operatively interact with said traversing plate and to shift said plate horizontally upon each activation of the knob;

(e) a first mechanical actuation means operatively interconnected between an intermediate anchor point on said plate and a first valve means cover provided proximal to the bottom of said first compartment, whereby a lateral shift of said plate opens said first valve means, permitting water flow from said first larger compartment to said toilet bowl;

(f) a second mechanical actuation means operatively interconnected between a movable first support pin operatively associated with said plate and a second valve cover means provided proximal to the bottom of said second compartment, whereby a lateral shift of said plate opens said second valve means permitting flow from said second smaller compartment to said toilet bowl;

(g) a pair of spaced-apart, axially-aligned linear slots provided in a planar surface of said plate and adapted to operatively receive a pair of horizontally disposed, plate support pins;

(h) a plurality of regularly configured, corrugation-like, recesses disposed along a lower linear edge of said plate;

(i) a pair of spring-loaded pivot points rotably affixed to a support wall and adapted to track the undulating lower edge of said control plate;

(j) a pair of pivotable lever means, with each of such means affixed at its one pivotable longitudinal end to a wall of the holding tank and hingedly anchored at its other longitudinal end to an external end of one of the horizontally-disposed plate support pins;

(k) a third mechanical means operatively attached to said plate and adapted to provide a constant retrogressive lateral force that will shift said plate rightwardly only while the leftward biasing hinged cantilever means are disconnected from contact with the plate underside recesses; and, (l) a pair of normally vertically aligned, keeper levers riding along the upper edge of said traversing plate and serving to maintain said plate in the lower of its two horizontal levels until the plate shifts laterally to the leftward limit of its traverse, and then said pair being adapted to release said plate to move to its horizontal level of traverse for return to its initial rightward position by the force now exerted by said third mechancial means.

2. The toilet system according to claim 1 wherein the volume ratio of the larger water storage compartment to the smaller compartment is about five to one.

3. The toilet system according to claim 1 wherein the second conduit means is provided with an enlarged waste storage volume serving as an interim waste container and is further provided with at least one spring-loaded, gas-lock valve positioned between the bowl and the second conduit to preclude sewer gas flowback.

4. The toilet system according to claim 1 wherein said traversing plate is generally rectangular with its longer linear dimension positioned longitudinal of the storage tank configuration and also having said linear dimension ranging from six to ten times its planar transverse dimension.

5. The toilet system according to claim 1 wherein the paired linear slots of the traversing slots of the traversing plate are located so to carry the plate horizontally in a leftward direction until reaching the leftward limit of said plate travel and retaining said limit until an alternate actuation means intervene.

6. The toilet system according to claim 1 wherein the lower edge regular recesses extend substantially over the entire length of said traversing plate.

7. The toilet system according to claim 1 wherein the upper edge of said plate is provided with two spaced-apart, inward recesses adapted to slidingly engage the depending lower end of the keeper levers and contoured so that upon rightward shifting of the plate, serve to facilitate pivoting of said levers to a position coincidental with the plate upper edge until the plate retrogresses to its initial position.

8. The toilet system according to claim 1 wherein the pivotable lever means linking their opposing longitudinal ends between the tank back wall and the plate linear slots have an crank-shaped configuration which rotates to serve their lifting function for the plate at the end of its leftward travel.

* * * * *